US008696325B2

(12) United States Patent
Yu et al.

(10) Patent No.: US 8,696,325 B2
(45) Date of Patent: Apr. 15, 2014

(54) RETURN TO NEUTRAL MECHANISM FOR HYDRAULIC PUMP

(75) Inventors: Gang Yu, Jiangsu (CN); Zhongming Ye, Jiangsu (CN); Fugang Li, Jiangsu (CN)

(73) Assignee: White Drive Products, Inc., Hopkinsville, KY (US)

( * ) Notice: Subject to any disclaimer, the term of this patent is extended or adjusted under 35 U.S.C. 154(b) by 431 days.

(21) Appl. No.: 13/262,074

(22) PCT Filed: Mar. 18, 2010

(86) PCT No.: PCT/CN2010/071133
§ 371 (c)(1),
(2), (4) Date: Sep. 29, 2011

(87) PCT Pub. No.: WO2011/113205
PCT Pub. Date: Sep. 22, 2011

(65) Prior Publication Data
US 2012/0027626 A1 Feb. 2, 2012

(51) Int. Cl.
*F04B 1/20* (2006.01)
*F01B 13/04* (2006.01)

(52) U.S. Cl.
USPC ..... 417/269; 92/12.2; 92/13

(58) Field of Classification Search
USPC ..... 417/269, 222.1–222.2; 92/12.2, 13.7, 92/71; 91/505
See application file for complete search history.

(56) References Cited

U.S. PATENT DOCUMENTS 5,894,783 A * 4/1999 Hauser et al. ..... 92/12.2
(Continued)

FOREIGN PATENT DOCUMENTS

| | | |
|---|---|---|
| CN | 100422507 | 10/2008 |
| DE | 10344069 | 12/2004 |
| EP | 1500785 | 1/2005 |

OTHER PUBLICATIONS

International Search Report and Written Opinion of PCT/CN2010/071133 dated Dec. 30, 2010.

*Primary Examiner* — Charles Freay
(74) *Attorney, Agent, or Firm* — Rankin, Hill & Clark LLP

(57) ABSTRACT

A hydraulic pump includes a housing (12), a cylinder block (14), a plurality of pistons (16), a swash plate (18), a trunnion arm (22), a first biasing assembly (54), and a second biasing assembly (56). The cylinder block includes a plurality of piston chambers. The swash plate is disposed for pivotal movement in the housing and cooperates with the pistons to vary the working volume of the piston chambers. The swash plate is pivotal about a pivot axis (80). The trunnion arm includes a cylindrical shaft portion (140) and a cam portion (142) connected with or integrally formed with the shaft portion. The trunnion arm is operatively connected with the swash plate for controlling pivotal movement of the swash plate. The cylindrical shaft portion defines a trunnion arm rotational axis (144) that is parallel to and offset from the pivot axis (80). The cam portion is disposed within the housing and includes a first lateral cam surface (154) and a second lateral cam surface (156) disposed on an opposite side of a cam portion axis (158) that extends through the cam portion, intersects the trunnion arm rotational axis and is perpendicular to the trunnion arm rotational axis. The first biasing assembly (54) is disposed in the housing and cooperates with the first lateral cam surface to urge the cam portion in a first direction toward a neutral position. The second biasing assembly (56) is disposed in the housing and cooperates with the second lateral cam surface to urge the cam portion in a second direction toward the neutral position. The second direction is opposite to the first direction.

15 Claims, 2 Drawing Sheets

(56) References Cited

U.S. PATENT DOCUMENTS

| | | | | |
|---|---|---|---|---|
| RE37,049 | E * | 2/2001 | Ishii et al. | 60/487 |
| 6,701,825 | B1 | 3/2004 | Langenfeld | |
| 6,889,595 | B1 | 5/2005 | Trimble | |
| 7,089,644 | B2 * | 8/2006 | Jolliff et al. | 29/469 |
| 2008/0245066 | A1 | 10/2008 | Mish et al. | |
| 2008/0271444 | A1 | 11/2008 | Daigre | |

* cited by examiner

RETURN TO NEUTRAL MECHANISM FOR HYDRAULIC PUMP

BACKGROUND

The present disclosure relates to a return to neutral ("RTN") mechanism for a hydraulic axial pump and a hydraulic pump including such an RTN mechanism.

Hydraulic axial piston pumps are often hydraulically connected to a hydraulic motor through a hydraulic circuit. The pump is typically driven by an input shaft that connects to pulleys and belts. The pulleys and belts connect to an internal combustion engine. Axial pistons in the pump engage a pivotable swash plate and as the pump is rotated, the pistons engage the swash plate. Movement of the pistons results in movement of the hydraulic fluid from the pump to the motor. Pivotal movement of the swash plate is generally controlled by a trunnion arm that is connected via linkages to either a hand control or foot pedal mechanism that is operated by an operator of the vehicle that includes the hydraulic pump and motor.

The hydraulic pump described above has a neutral position where the pump pistons are not moved in an axial direction so that rotation of the pump does not create any movement of hydraulic fluid out of the pump. RTN mechanisms operate with the swash plate to return the swash plate to a neutral position when a force is no longer being applied to rotate the trunnion arm. Such devices can minimize unintended movement of the vehicle and can also return the pump to neutral in the event of a vehicle operator no longer being able to engage the hand control or foot pedal mechanism that is connected through a linkage to the trunnion arm.

SUMMARY

A hydraulic pump having an improved return to neutral mechanism design includes a housing, a cylinder block, a plurality of pistons, a swash plate, a trunnion arm, a first biasing assembly, and a second biasing assembly. The cylinder block is disposed for rotational movement within the housing and includes a plurality of piston chambers. The cylinder block rotates about a cylinder block rotational axis. Each piston is received in a respective piston chamber. The swash plate is disposed for pivotal movement in the housing and cooperates with the pistons to vary a working volume of the piston chambers. The swash plate is pivotal about a pivot axis. The trunnion arm includes a cylindrical shaft portion and a cam portion connected with or integrally formed with the shaft portion. The trunnion arm is operatively connected with the swash plate for controlling pivotal movement of the swash plate. The cylindrical shaft portion defines a trunnion arm rotational axis that is parallel to and offset from the pivot axis. The cam portion is disposed within the housing and includes a first lateral cam surface and a second lateral cam surface disposed on an opposite side of a cam portion axis that extends through the cam portion, intersects the trunnion arm rotational axis and is perpendicular to the trunnion arm rotational axis. The first biasing assembly is disposed in the housing and cooperates with the first lateral cam surface to urge the cam portion in a first direction toward a neutral position. The second biasing assembly is disposed in the housing and cooperates with the second lateral cam surface to urge the cam portion in a second direction toward the neutral position. The second direction is opposite the first direction.

An example of a return to neutral ("RTN") mechanism for a hydraulic axial piston pump includes a cam portion connected with or integrally formed with a cylindrical portion of a trunnion arm having a trunnion arm rotational axis and operatively connected with a swash plate of the hydraulic pump. The cam portion is located in the hydraulic pump and includes a first curved lateral cam surface and a second curved lateral cam surface disposed on an opposite side of a symmetrical cam portion axis that extends through the cam portion, intersects the trunnion arm rotational axis and is perpendicular to the trunnion arm rotational axis. The RTN mechanism also includes a first biasing assembly and a second biasing assembly. The first biasing assembly is located in the hydraulic pump and cooperates with the first lateral cam surface to urge the cam portion in a first direction toward a neutral position. The second biasing assembly is located in the hydraulic pump and cooperates with the second lateral cam surface to urge the cam portion in a second direction toward the neutral position. The second direction is opposite the first direction.

DETAILED DESCRIPTION

Figure 1:
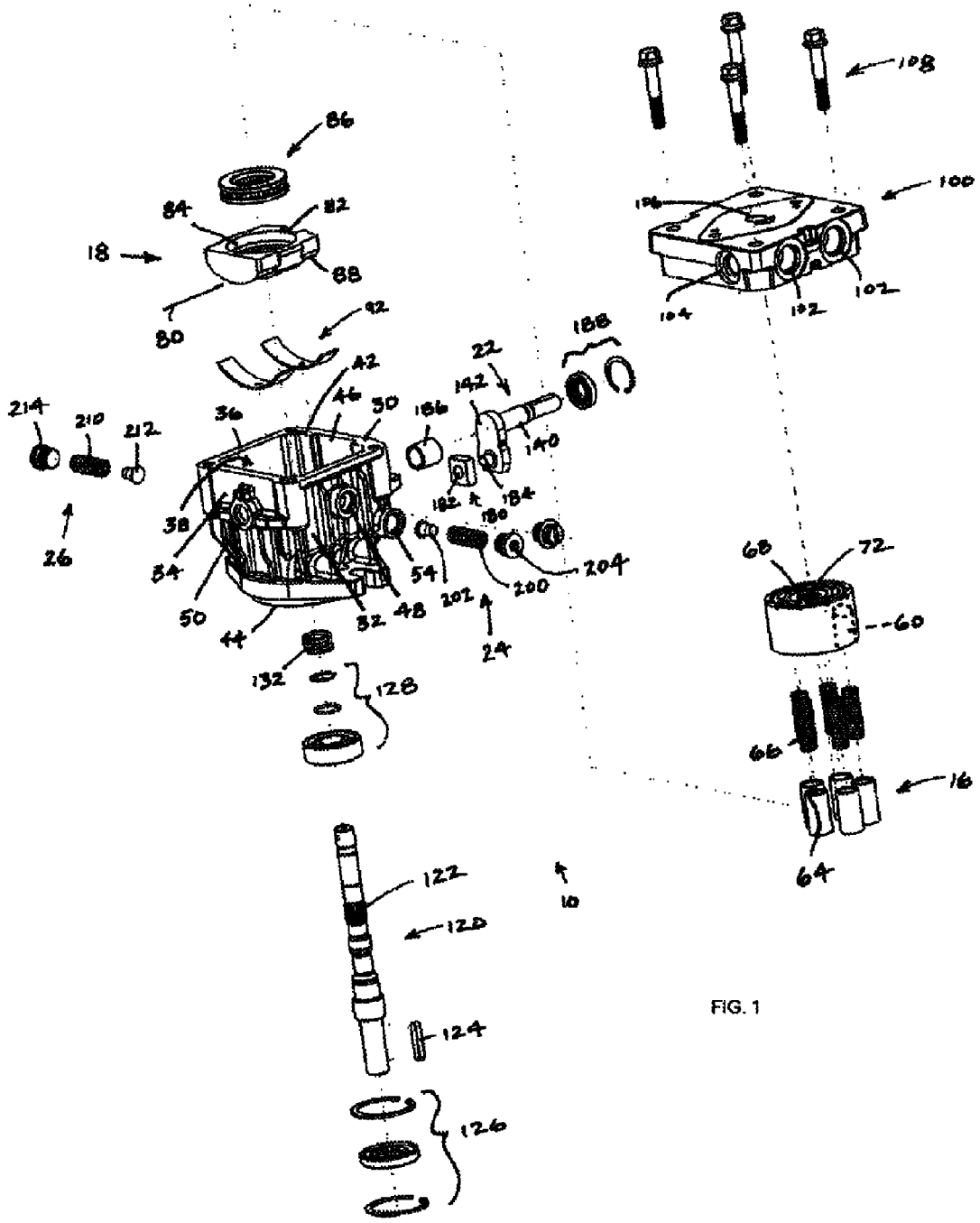
FIG. 1 is an exploded view of a hydraulic axial pump including an improved return to neutral ("RTN") mechanism.

With reference to FIG. 1, a hydraulic pump 10 includes a housing 12, a cylinder block 14, a plurality of pistons 16, a swash plate 18, a trunnion arm 22, a first biasing assembly 24, and a second biasing assembly 26. The biasing assemblies 24 and 26 cooperate with the trunnion arm 22 to place the pump 10 into a neutral position so that rotation of the pump does not create any movement of hydraulic fluid out of the pump to an external device, such as a hydraulic motor, that is connected to the pump.

In the illustrated embodiment, the pump 10 is configured to include four sidewalls: a first sidewall 30, a second sidewall 32, a third sidewall 34, and a fourth sidewall 36. The sidewalls 30-36 define an internal cavity 38, an open first end 42 and an open second end 44. In the illustrated embodiment, the open first end 42 is generally rectangular or square in configuration and the open second end 44 is generally circular or cylindrical in configuration. The internal cavity 38 also includes a cutout 46 extending outwardly from the cavity 38 into a sidewall (the first sidewall 30 as illustrated) of the housing 12.

Figure 3:
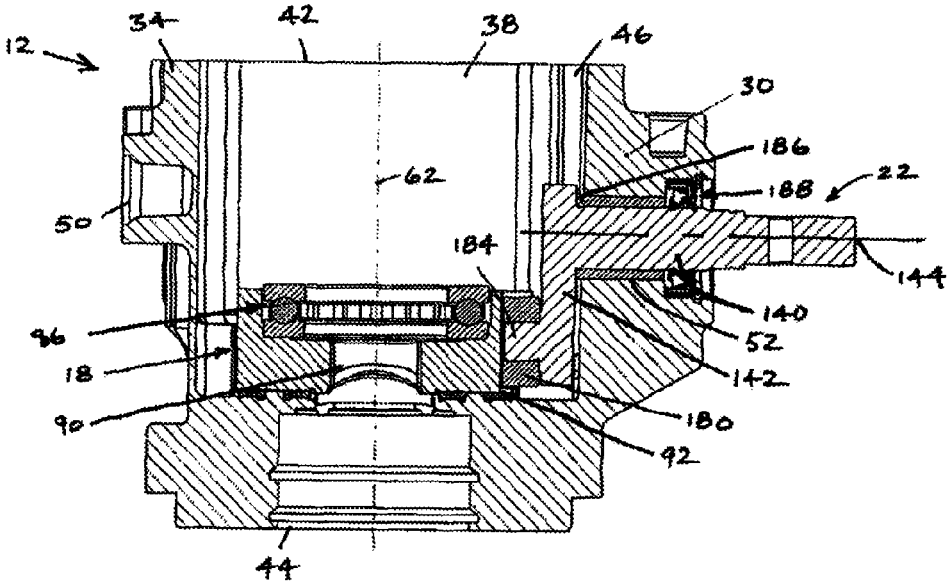
FIG. 3 is another cross-sectional view of the hydraulic pump.

The housing 12 further includes a plurality of bores extending from an external surface of the housing 12 into the internal cavity 38. For example, the second wall 32 of the housing 12 includes a case drain port 48 extending from an external surface of the housing 12 into the cavity 38. The housing 12 can also include case drain locations 50. With reference to FIG. 3, the case drain locations 50 are generally cylindrical bores that emanate from an external surface of the housing 12, but do not extend through the respective wall (for example the third wall 34) into the internal cavity 38 of the housing 12. The case drain port 48 and the case drain locations 50 can be provided on sidewalls of the housing 12 other than that which is shown in FIG. 1. The housing 12 also includes a trunnion arm bore 52 (FIG. 3) that extends form an external surface of the housing (the first side wall 30 in the depicted embodiment) into the internal cavity. The trunnion arm 22 is received in and extends through the trunnion arm bore 52.

Figure 2:
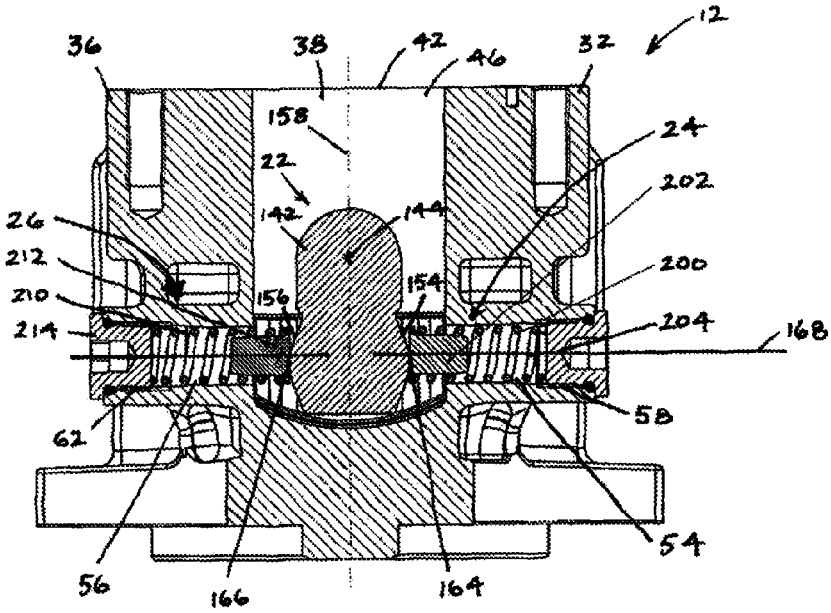
FIG. 2 is a cross-sectional view taken through a side of a housing of the pump shown in FIG. 1 showing the RTN mechanism.

As more clearly shown in FIG. 2, the housing 12 also includes biasing assembly bores, which can include a first biasing assembly bore 54 and a second biasing assembly bore 56. The first biasing assembly bore 54 can include an internally threaded counterbore 58 adjacent an external surface of the housing 12. Similarly, the second biasing assembly bore 56 can also include an internally threaded counterbore 62 adjacent an external surface of the housing 12. As more clearly seen in FIG. 2, in the illustrated embodiment the first biasing assembly bore 54 is generally cylindrical and coaxial with the second biasing assembly bore 56, which is also generally cylindrical.

With reference back to FIG. 1, the cylindrical block 14 is disposed for rotational movement within the housing 12 and includes a plurality of piston chambers 60 (only one shown in phantom in FIG. 1). The cylinder block 14 rotates about a cylindrical block rotational axis 62 (FIG. 3, the cylinder block 14 is not shown in FIG. 3). Each piston 16 also includes a generally cylindrical cavity 64 that receives a respective spring 66 that biases each piston 16 toward the swash plate 18. The cylinder block 14 also includes a central bore 68 having internal splines 72. The central bore 68 is cylindrical having a central axis coaxial with the cylindrical block rotational axis 62.

The swash plate 18 is disposed for pivotal movement in the housing 12 and cooperates with the pistons 16 to vary a working volume of the piston chambers 60. The swash plate 18 is pivotal about a pivot axis 80. The swash plate 18 includes a notch 82 formed in a lateral planar external surface and a cylindrical recess 84 for receiving a cylindrical swash plate bearing 86. The swash plate 18 also includes convex bearing surfaces 88 that cooperates with cradle bearings 92 that are received in the internal cavity 38 of the housing 12. The swash plate bearing 86 acts against the pistons 16 to vary the working volume of the piston chambers 60 as the cylinder block 14 is rotated about the cylinder block rotational axis 62 (FIG. 3). With reference to FIG. 3, the swash plate 18 includes a central opening 90.

With reference back to FIG. 1, the hydraulic pump 10 also includes a port plate 100, which acts as an upper housing part for the pump. The port plate 100 closes off the first end 42 of the housing 12. The port plate 100 includes inlet/outlet openings 102 that are in fluid communication with the piston chambers 60 and are configured to connect with return and supply lines, respectively, that provide fluid to a motor or other external device driven by the pump 10. The port plate 100 can further include additional bores, such as a bore 104, which is configured to receive a valve, such as a relief valve (not shown), that can be incorporated into the pump 10. The port plate 100 can also include a fluid supply inlet 106 that can communicate with a charge pump (not shown) to supply hydraulic fluid to the circuit that includes the hydraulic pump 10. The port plate 100 attaches to the housing 12 using conventional fasteners such as bolts 108.

The hydraulic pump 10 depicted in FIG. 1 also includes an input shaft 120 that can be driven through pulleys and belts (not shown), or a similar transmission, by an external device such as an internal combustion engine. The input shaft 120 is received through the second end 44 of the housing 12 and the central opening 90 of the swash plate 18. The input shaft 120 connects with the cylinder block 14 by being received in the central bore 68. The input shaft 120 includes external splines 122 that engage with the internal splines 72 in the central bore 68 of the cylinder block 14 so that rotation of the input shaft 120 about the cylinder block rotational axis 62 results in rotation of the cylinder block 14 the cylinder block rotational axis. A key 124 connects with the input shaft 120 to allow for engagement with a pulley to drive the input shaft. A seal assembly 126 receives the input shaft 120 to seal the internal cavity 38 of the housing 12 at the second end 44 of the housing. A bearing assembly 128 and a spring 132 can surround the input shaft 120 inside the housing cavity 38.

The trunnion arm 22 in the illustrated embodiment includes a cylindrical shaft portion 140 and a cam portion 142 connected with or integrally formed with the shaft portion. The trunnion arm 22 is operatively connected with the swash plate 18 for controlling pivotal movement of the swash plate. With reference to FIG. 3, the cylindrical shaft portion 140 of the trunnion arm 22 defines a trunnion arm rotational axis 144 that is parallel to and offset from the pivot axis 80. The cylindrical shaft portion 140 extends through the trunnion arm bore 52 that is formed in the first sidewall 30 of the housing 12.

The cam portion 142 of the trunnion arm 22 is disposed within the housing 12, and more particularly within the cutout 46 of the cavity 38. With reference to FIG. 2, the cam portion 142 includes a first lateral cam surface 154 and a second lateral cam surface 156 disposed on an opposite side of a cam portion axis 158 that extends through the cam portion 142, intersects the trunnion arm rotational axis 144 and is perpendicular to the trunnion arm rotational axis. The first biasing assembly 24, which is disposed in the housing 12, cooperates with the first lateral cam surface 154 to urge the cam portion in a first direction (leftward in FIG. 2) toward a neutral position. The second biasing assembly 26, which is also disposed in the housing 12, cooperates with the second lateral cam surface 156 to urge the cam portion 142 in a second direction (rightward in FIG. 2) toward the neutral position. As is apparent in FIG. 2, the second direction is opposite the first direction.

With continued reference to FIG. 2, each lateral cam surface 154 and 156 is convex. In the illustrated embodiment, each lateral cam surface defines a point of inflection in a cross section taken through the cam portion 142 in the plane in which the cam portion axis 158 resides. For example, the first lateral cam surface defines a first point of inflection 164 and the second lateral cam surface 156 defines a second point of inflection 166. FIG. 2 depicts the cam portion 142 in the neutral position and a line 168 intersecting each point of inflection 164 and 166 is perpendicular to the cam portion axis 158. By providing these points of inflection, the moment arm. i.e., the distance between the trunnion arm rotational axis 144 and where the cam portion 142 contacts the respective biasing assemblies 24 and 26, reduces or stays about the same as the cam portion 142 is rotated away from the neutral position. Such a configuration can reduce the required biasing force to bias the cam portion 142 toward the neutral position and can reduce the force required by an operator of the pump 10 to rotate the cam portion 142 from the neutral position.

With reference back to FIG. 1, the pump 10 also includes a sliding block 180. As mentioned above, the swash plate 18 includes the notch 82. The notch 82 in the swash plate 18 receives the sliding block 180 to connect the trunnion arm 22 to the swash plate 18. The sliding block 180 includes a cylindrical bore 182. The trunnion arm 22 includes a cylindrical extension 184 received in the cylindrical bore 182 of the sliding block 180, which is shown in FIG. 3. With reference back to FIG. 1, a hollow cylindrical sleeve 186 receives the cylindrical portion 140 of the trunnion arm 22. The sleeve 186 is received in the trunnion arm bore 52. A bearing and seal assembly 188 also receives the cylindrical portion 140 of the trunnion arm 22 and seals the trunnion arm bore 52.

With reference to FIG. 2, the first biasing assembly 24 and the second biasing assembly 26 are each disposed in the housing 12. As compared to externally mounted return to neutral ("RTN") mechanisms, placing the biasing assemblies 24 and 26 inside the housing 12 reduces exposure of the biasing assemblies to external elements, which can be highly desirable. As mentioned above, the housing 12 includes the cylindrical first biasing assembly bore 54 that receives the first biasing assembly 24 and the cylindrical second biasing assembly bore 56 that receives the second biasing assembly 26. With reference to FIG. 2, each biasing assembly bore 54 and 56 opens to the cavity 38 in the housing 12 that receives the cylinder block 14 and the cam portion 142 of the trunnion arm 22. Each biasing assembly 24 and 26 extends from the respective biasing assembly bore 54 and 56 into the cavity 38 of the housing, and more particularly into the cutout 46 as well as the cavity. Each biasing assembly bore 54 and 56 extends from an external surface of the housing 12 into the cavity 38 of the housing. More particularly, the first biasing assembly bore 54 extends from an external surface of the second wall 32 of the housing 12 into the cavity 38 and the second biasing assembly bore 56 extends from an external surface of the third wall 36 of the housing 12 into the cavity 38.

The first biasing assembly 24 includes a compression spring 200, a spring seat 202 seated against an internal end of the compression spring and a spring retainer 204 seated against an external end of the compression spring. Similarly, the second biasing member 26 includes a compression spring 210, a spring seat 212 seated against an inner end of the compression spring, and a spring retainer 214 seated against an external end of the compression spring. With reference to FIG. 2, the biasing assemblies 24 and 26 each include a compression spring 200 and 210, respectively, having a coil axis where the coil axes are coaxial and are perpendicular to the pivot axis 80 of the swash plate 18 and the trunnion arm rotational axis 144. The first compression spring 200 is retained in the first biasing assembly bore 54 by the spring retainer 204 being threaded in the threaded portion 58 of the first biasing assembly bore 54. Similarly, the second compression spring 210 is retained inside the second biasing assembly bore 56 by the second spring retainer 214 being threaded into the threaded portion 62 of the second biasing assembly bore 56. The first spring seat 202 contacts the first lateral cam surface 154 of the cam portion 142 of the trunnion arm 22 biasing the cam portion 142, and thus the trunnion arm 22, in a first (leftward direction in FIG. 2) direction. The second spring seat 212 contacts the second lateral cam surface 156 of the cam portion 142 biasing the cam portion 142, and thus the trunnion arm 22, in a second (rightward in FIG. 2) direction. In the illustrated embodiment, the cam portion 142 is symmetrical with respect to the cam portion axis 158. Accordingly, the biasing force provided by each compression spring 200 and 210 can be equal and opposite to one another so that rotation of the trunnion arm 22 in either direction is biased toward the neutral position in an even manner.

In operation, the trunnion arm 22 is rotated about the trunnion arm rotational axis 144 by an operator maneuvering a handle or foot pedal connected with the trunnion arm through a linkage. With reference to FIG. 2, where the cam portion 142 of the trunnion arm 22 is rotated in a counterclockwise direction, the first biasing assembly 24 urges the cam portion 142 in a clockwise direction when the force on the trunnion arm is removed. If the trunnion arm 22 is rotated in a clockwise direction, the second biasing assembly 26 acts against the second lateral cam surface 156 urging the cam portion 142 of the trunnion arm to rotate the trunnion arm in a counterclockwise direction when the force on the trunnion arm has been removed. If desired, the compression springs 202 and 210 could be replaced with tension springs where the tension springs attach to the cam portion 142 of the trunnion arm 22 and each tension spring urges rotational movement of the trunnion arm about the trunnion arm axis 144 in opposite directions.

A hydraulic pump and an RTN mechanism for a hydraulic pump have been described above in particularity. Modifications and alterations will occur to those upon reading and understanding the preceding detailed description. The invention is not limited to only the embodiment and the alternatives described above. Instead, the invention is broadly defined by the appended claims and the equivalents thereof.

It will be appreciated that various of the above-disclosed and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A hydraulic pump comprising:

a housing;

a cylinder block disposed for rotational movement within the housing and including a plurality of piston chambers, wherein the cylinder block rotates about a cylinder block rotational axis;

a plurality of pistons, each piston being received in a respective piston chamber;

a swash plate disposed for pivotal movement in the housing and cooperating with the pistons to vary a working volume of the piston chambers, the swash plate being pivotal about a pivot axis;

a trunnion arm including a cylindrical shaft portion and a cam portion connected with or integrally formed with the shaft portion, the trunnion arm being operatively connected with the swash plate for controlling pivotal movement of the swash plate, the cylindrical shaft portion defines a trunnion arm rotational axis that is parallel to and offset from the pivot axis, the cam portion being disposed within the housing and including a first lateral cam surface and a second lateral cam surface disposed on an opposite side of a cam portion axis that extends through the cam portion, intersects the trunnion arm rotational axis and is perpendicular to the trunnion arm rotational axis;

a first biasing assembly disposed in the housing and cooperating with the first lateral cam surface to urge the cam portion in a first direction toward a neutral position; and a second biasing assembly disposed in the housing and cooperating with the second lateral cam surface to urge the cam portion in a second direction toward the neutral position, wherein the second direction is opposite the first direction.

2. The pump of claim 1, wherein the cam portion is symmetrical with respect to the cam portion axis.

3. The pump of claim 1, wherein each lateral cam surface has a convex configuration.

4. The pump of claim 3, wherein each lateral cam surface defines a point of inflection, wherein a line intersecting each point of inflection is perpendicular to the cam portion axis.

5. The pump of claim 3, further comprising a sliding block, wherein the swash plate includes a notch receiving the sliding block and the trunnion arm includes a cylindrical extension received in a cylindrical bore of the sliding block, a central axis of the cylindrical extension being intersected by the cam portion axis.

6. The pump of claim 1, wherein the cam portion axis is parallel to a rotational axis of the cylinder block when the cam portion is in the neutral position.

7. The pump of claim 1, wherein the housing includes a cylindrical first biasing assembly bore receiving the first biasing assembly and a cylindrical second biasing assembly bore receiving the second biasing assembly, each biasing assembly bore opens to a cavity in the housing receiving the cylinder block and the cam portion, each biasing assembly extending from the respective biasing assembly bore into the cavity.

8. The pump of claim 7, wherein the cavity includes a cut out extending outwardly from the cavity into a side wall of the housing, wherein the cam portion resides in the cut out.

9. The pump of claim 7, wherein the first biasing assembly bore is coaxial with the second biasing assembly bore.

10. The pump of claim 7, wherein each biasing assembly bore extends from an external surface of the housing into the cavity of the housing.

11. The pump of claim 5, wherein the biasing assemblies each include a compression spring having a coil axis, wherein the coil axes are coaxial and are perpendicular to the trunnion arm rotational axis.

12. The pump of claim 7, wherein each biasing assembly bore extends from an external surface of a housing into the cavity of the housing.

13. A return to neutral ("RTN") mechanism for a hydraulic axial piston pump, the RTN mechanism comprising:

a cam portion connected with or integrally formed with a cylindrical portion of a trunnion arm having a trunnion arm rotational axis and operatively connected with a swash plate of the hydraulic pump, the cam portion being located within the hydraulic pump and including a first curved lateral cam surface and a second curved lateral cam surface disposed on an opposite side of a symmetrical cam portion axis that extends through the cam portion, intersects the trunnion arm rotational axis and is perpendicular to the trunnion arm rotational axis;

a first biasing assembly in the hydraulic pump cooperating with the first lateral cam surface to urge the cam portion in a first direction toward a neutral position; and a second biasing assembly in the hydraulic pump cooperating with the second lateral cam surface to urge the cam portion in a second direction toward the neutral position, wherein the second direction is opposite the first direction.

14. The RTN mechanism of claim 13, wherein each lateral cam surface defines a point of inflection, wherein a line intersecting each point of inflection is perpendicular to the cam portion axis when the cam portion is in the neutral position.

15. The RTN mechanism of claim 13, wherein the biasing assemblies each include a compression spring having a coil axis, wherein the coil axes are coaxial and are perpendicular to the trunnion arm rotational axis.

* * * * *